US010502105B2

(12) United States Patent
Türk et al.

(10) Patent No.: US 10,502,105 B2
(45) Date of Patent: Dec. 10, 2019

(54) DIVIDING WALL STRUCTURE WITH INTEGRATED LIQUID DELIVERY FUNCTION

(71) Applicant: MAN TRUCK & BUS AG, München (DE)

(72) Inventors: Jens Türk, Postbauer-Heng (DE); Thomas Haberl, Vilseck (DE)

(73) Assignee: MAN Truck & Bus AG, Munich (DE)

( * ) Notice: Subject to any disclaimer, the term of this patent is extended or adjusted under 35 U.S.C. 154(b) by 123 days.

(21) Appl. No.: 15/187,367

(22) Filed: Jun. 20, 2016

(65) Prior Publication Data

US 2016/0369671 A1 Dec. 22, 2016

(30) Foreign Application Priority Data

Jun. 20, 2015 (DE) ..... 10 2015 007 909

(51) Int. Cl.
*F01M 11/04* (2006.01)
*F01M 11/00* (2006.01)
*F01M 1/06* (2006.01)

(52) U.S. Cl.
CPC ..... *F01M 11/0004* (2013.01); *F01M 1/06* (2013.01); *F01M 2011/005* (2013.01)

(58) Field of Classification Search
CPC . F01M 11/0004; F01M 1/06; F01M 2011/005
USPC ..... 123/198 E, 198 DA, 196 R
See application file for complete search history.

(56) References Cited

U.S. PATENT DOCUMENTS 2,093,570 A * 9/1937 Meyer ..... F01L 5/10 184/11.1
4,270,497 A * 6/1981 Valerio ..... F01M 11/0004 123/195 C
4,524,735 A * 6/1985 Bauder ..... F01M 11/00 123/196 R
5,038,890 A * 8/1991 Tanaka ..... F01M 11/0004 123/196 R
5,190,121 A * 3/1993 Muzyk ..... F01M 1/02 123/196 R
6,076,495 A * 6/2000 Takahashi ..... F01M 11/02 123/195 C
6,192,853 B1 * 2/2001 Natsume ..... F01M 1/02 123/195 P
6,286,476 B1 * 9/2001 Hiraoka ..... F01M 11/02 123/196 R (Continued)

FOREIGN PATENT DOCUMENTS

DE 4139195 6/1993
DE 102008060412 6/2010

(Continued)

OTHER PUBLICATIONS

Search Report dated Nov. 11, 2016 which issued in the corresponding European Patent Application No. 16001155.7.

*Primary Examiner* — George C Jin
*Assistant Examiner* — Teuta B Holbrook
(74) *Attorney, Agent, or Firm* — Cozen O'Connor

(57) ABSTRACT

A dividing wall structure for a liquid collecting device and for a vehicle structure having a crankshaft and connecting rods. The dividing wall structure includes liquid channels and shaped portions for turning crankshaft and/or connecting-rod sections. Liquid can be forced out of the shaped portions associated liquid collecting device.

20 Claims, 7 Drawing Sheets

(56) References Cited

U.S. PATENT DOCUMENTS

| | | | | |
|---|---|---|---|---|
| 6,729,292 | B1 | 5/2004 | Bock et al. | |
| 6,786,188 | B1 * | 9/2004 | Kawamoto | F01M 1/12 123/196 R |
| 6,823,967 | B1 * | 11/2004 | Hoi | F01M 1/20 184/6.9 |
| 7,267,094 | B2 * | 9/2007 | Tawarada | F01M 11/02 123/196 CP |
| 7,472,675 | B2 * | 1/2009 | Reustle | F01M 11/0004 123/195 C |
| 8,292,037 | B2 * | 10/2012 | Kawamura | F01M 1/04 123/196 R |
| 8,302,577 | B2 | 11/2012 | Wunsch et al. | |
| 9,457,881 | B1 * | 10/2016 | Belter | B63H 20/001 |
| 2005/0081814 | A1 | 4/2005 | Saito | |
| 2009/0218169 | A1 * | 9/2009 | Kawamura | F01M 1/04 184/6.5 |

FOREIGN PATENT DOCUMENTS

| | | | | |
|---|---|---|---|---|
| DE | 102010055189 | A1 * | 6/2012 | F01M 11/0004 |
| EP | 0140108 | | 5/1985 | |
| EP | 1892390 | | 2/2008 | |
| JP | 2010-151011 | | 7/2010 | |

* cited by examiner

DIVIDING WALL STRUCTURE WITH INTEGRATED LIQUID DELIVERY FUNCTION

BACKGROUND OF THE INVENTION

1. Field of the Invention

The invention relates to a dividing wall structure for a liquid collecting device for a vehicle structure comprising a crankshaft and connecting rods, preferably a combustion engine (e.g. an internal combustion engine). The invention likewise relates to an associated liquid collecting device.

2. Description of the Related Art

Oil collecting devices for arranged beneath crankshaft/connecting rod structures are known in a very wide variety of embodiments in the prior art. The particular disadvantage of conventional oil collecting devices is the fact that oil can collect in corner regions of the oil collecting devices when in a sloping position, with the result that a suction cage lies above the oil level of the oil to be extracted. Another disadvantage with conventional oil collecting devices is, for example, that they tend towards relatively heavy oil deposits.

SUMMARY OF THE INVENTION

It is an object of one aspect of the invention to provide an improved and/or alternative liquid collecting device can be obtained.

The invention provides a dividing wall structure for a liquid collecting device for a vehicle structure comprising a crankshaft and connecting rods, e.g. a combustion engine, in particular an internal combustion engine (e.g. diesel engine) or some other piston machine.

The dividing wall structure comprises at least two liquid channels and at least two shaped portions for turning, in particular rotating, crankshaft and/or connecting-rod sections, whereby liquid can be forced out of the shaped portions, preferably via the liquid channels, and in particular can be delivered, e.g. pumped and/or squeezed, out of the shaped portions. In particular, each shaped portion is used for one turning crankshaft and/or connecting-rod section.

Consequently, the dividing wall structure is embodied in such a way that it allows exploitation of a turning motion, in particular the turning motion performed during normal operation, of the crankshaft and/or connecting-rod sections, to force liquid out of the shaped portions, preferably from recess to recess and/or towards a liquid extraction region.

Consequently, the dividing wall structure can have an integrated liquid delivery function, in particular, together with turning crankshaft and/or connecting-rod sections.

The dividing wall structure can be formed from a single dividing wall element or from a plurality of, preferably at least two, separate dividing wall elements.

The crankshaft and/or connecting-rod sections expediently comprise lower crankshaft and/or connecting-rod sections, preferably the lowermost crankshaft and/or connecting-rod sections.

It is possible for at least one liquid channel to connect one shaped portion to another shaped portion, preferably an adjacent shaped portion, expediently directly or indirectly, with the result that liquid delivery, in particular from shaped portion to shaped portion and/or towards a liquid extraction region, is preferably made possible. As an alternative or supplementary measure, it is possible for at least one liquid channel to connect a shaped portion to a liquid extraction region, expediently directly or indirectly, thus preferably allowing liquid delivery, in particular from shaped portion to shaped portion and/or towards the liquid extraction region.

At least one liquid channel can expediently have a liquid inlet and a liquid outlet. The liquid inlet can be formed in a shaped portion or adjacent thereto. The liquid outlet can be formed in another, preferably adjacent, shaped portion or adjacent thereto.

In the context of one aspect of the invention, it is consequently possible for at least one liquid channel to connect two, preferably adjacent, shaped portions directly (inlet in one shaped portion and outlet in the other shaped portion) or indirectly (inlet in one shaped portion or adjacent thereto and outlet in the other shaped portion or adjacent thereto).

In the context of one aspect of the invention, it is thus possible for at least one liquid channel to connect one shaped portion directly to a liquid extraction region (inlet in shaped portion and outlet in liquid extraction region) or indirectly (inlet in shaped portion or adjacent thereto and outlet in liquid extraction region or adjacent thereto).

It is possible for at least one liquid channel to have a channel cross section that tapers in the direction of liquid delivery in order, for example, to achieve a pressure difference and/or a delivery effect. The channel cross section preferably tapers in the direction of liquid delivery.

It is possible for a gap for receiving liquid to be formed between the shaped portions and the turning crankshaft and/or connecting-rod sections.

It is possible for the shaped portions to be designed in accordance with the envelope geometry of the turning motion of the crankshaft and/or connecting-rod sections, plus a clearance dimension (e.g. at least 1 mm, 2 mm, 3 mm, 4 mm or 5 mm) to form the gap to receive liquid between the shaped portions and the turning crankshaft and/or connecting-rod sections.

It follows from this, in particular, that the envelope geometry of a rotational motion of the crankshaft is mirrored in the dividing wall structure, expediently by the shaped portions. The mirror image is designed with a defined clearance, such that the clearance can form the gap.

In particular, the gap is embodied in such a way that liquid is forced out of the gap into the liquid channels by the turning motion of the crankshaft and/or connecting-rod sections.

In particular, the shaped portions are embodied in such a way that liquid is forced out of the shaped portions into the liquid channels by the turning motion of the crankshaft and/or connecting-rod sections.

The dividing wall structure is preferably used for arrangement under the vehicle structure and/or for arrangement under the crankshaft and the connecting rods.

The dividing wall structure is preferably embodied as a cover unit for the liquid collecting device.

The dividing wall structure can be embodied as a moulding, for example, e.g. as a plastic moulding, with integrated shaped portions and/or integrated liquid channels. This makes it possible, for example, for the shaped portions and liquid channels to be one-piece integral parts of the dividing wall structure.

The liquid is preferably oil.

The liquid from the shaped portions is preferably squeezed or pumped into the liquid channels by the turning crankshaft and/or connecting-rod sections.

The gap can therefore be referred to, in particular, as a pumping gap and/or the liquid channels can be referred to, in particular, as pump channels.

It should also be mentioned in the context of the invention that at least one liquid channel, in particular a liquid channel leading to the liquid extraction region, can be designed as a simple opening, recess and/or hole, that is to say preferably with essentially no longitudinal extent or a very short longitudinal extent.

It should furthermore be mentioned that a recess for a crankshaft bearing assembly can be formed between the shaped portions.

It should furthermore be mentioned that the shaped portions are designed as depressions in the dividing wall structure.

The shaped portions are preferably used to receive turning crankshaft and/or connecting-rod sections and, as an alternative or in addition, to receive liquid, in particular oil, from the vehicle structure.

The invention is not restricted to a dividing wall structure but also includes a liquid collecting device for a vehicle structure comprising a crankshaft and connecting rods, e.g. a combustion engine, in particular a diesel engine, or some other piston machine. The liquid collecting device is provided with a dividing wall structure as disclosed herein.

The liquid collecting device preferably comprises a liquid trough for receiving liquid, having a liquid extraction region that has a liquid extraction cage or some other liquid extraction device, for example.

The liquid extraction region is preferably arranged substantially in the center of the liquid trough. It is expedient for delivery to be towards the center because it is here that the liquid extraction region is situated, in particular with the liquid extraction device (liquid extraction cage). The liquid extraction device should be below the liquid level of the liquid extraction region at all times and thus in virtually any sloping position since otherwise air would be drawn into the liquid circuit and, for example, it would thus no longer be possible to ensure engine lubrication or at least no longer possible to ensure proper engine lubrication.

The liquid collecting device can furthermore have a pump unit for extracting the liquid from the liquid extraction region, in particular by means of the liquid extraction device.

It should be mentioned that the vehicle structure preferably comprises an internal combustion engine, in particular diesel engine, which is stationary, for example. However, it can also comprise some other piston machine (e.g. lubricating circuit, oil sump etc.).

The dividing wall structure comprises a plurality of shaped portions, e.g. at least four, at least five or at least six shaped portions, wherein one shaped portion is expediently formed for each turning crankshaft and/or connecting-rod section.

The invention furthermore relates to an arrangement having a vehicle structure, which comprises a crankshaft and connecting rods, and a liquid collecting device as disclosed herein.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings.

The above-described preferred embodiments and features of the invention can be combined with one another. Other advantageous developments of the invention are disclosed in the dependent claims and will become apparent from the following description of preferred embodiments of the invention in conjunction with the attached figures.

DETAILED DESCRIPTION OF THE PRESENTLY PREFERRED EMBODIMENTS

Figure 1:
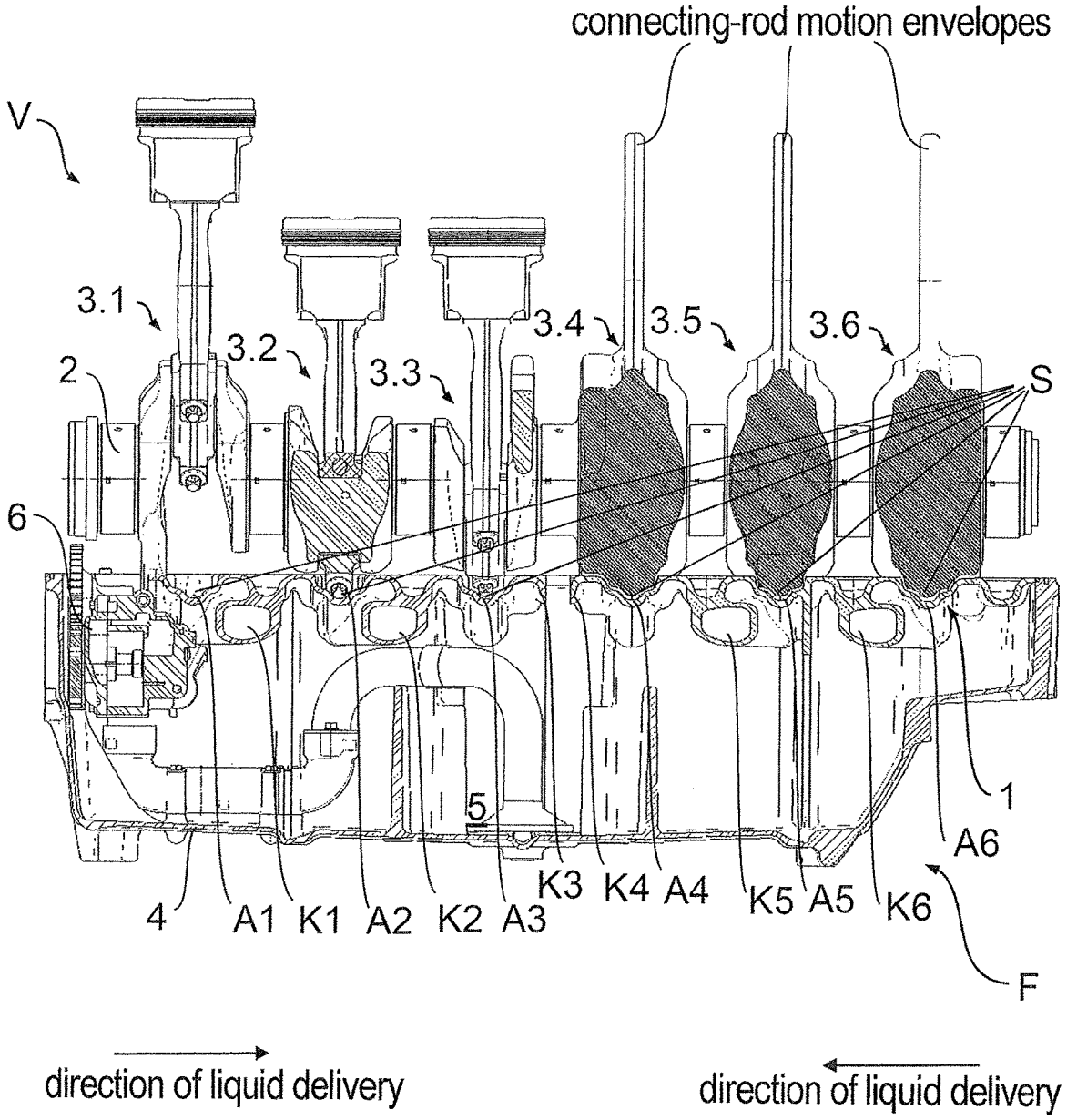
FIG. 1 is a section through a dividing wall structure and a liquid collecting device.

FIG. 1 shows a liquid collecting device F having a dividing wall structure 1 for a vehicle structure V comprising a crankshaft 2 and connecting rods 3.1 to 3.6. In particular, the liquid collecting device F is an oil collecting device F, and therefore the figures are described below with reference to oil as the liquid, although the invention is not restricted thereto.

The dividing wall structure 1 is embodied as a cover unit for the oil collecting device F and is arranged underneath the crankshaft 2 and the connecting rods 3.1 to 3.6.

Underneath the dividing wall structure 1, the oil collecting device F comprises an oil sump 4 for collecting oil from the vehicle structure V. The oil sump 4 comprises an oil extraction region 5, from which oil can be pumped away by way of an oil pump 6 by an oil suction cage arranged in the oil extraction region 5.

The dividing wall structure 1 is made up of two separate dividing wall elements, a left-hand dividing wall element and a right-hand dividing wall element in FIG. 1. The dividing wall elements are preferably embodied so as to be symmetrical with one another.

The dividing wall structure 1 comprises a plurality of oil channels K1, K2, K3, K4, K5 and K6 and a plurality of shaped portions A1, A2, A3, A4, A5 and A6 for turning crankshaft and/or connecting-rod sections, expediently lower, in particular lowermost crankshaft and/or connecting-rod sections. One shaped portion A1 to A6 is provided for each connecting rod 3.1 to 3.6 and thus for each crankshaft and/or connecting-rod section.

The shaped portions A1 to A6 are shaped in such a way that oil is forced out of the shaped portions A1 to A6 into the liquid channels K1 to K6 by the turning motion of the crankshaft and/or connecting-rod sections, with the result that oil delivery from shaped portion to shaped portion towards the oil extraction region 5 is achieved.

In particular, oil is forced out of shaped portion A1 to shaped portion A2 via liquid channel K1, oil is forced out of shaped portion A2 to shaped portion A3 via liquid channel K2, and oil is forced out of shaped portion A3 towards the oil extraction region 5 via liquid channel K3.

In particular, oil is forced out of shaped portion A6 to shaped portion A5 via liquid channel K6, oil is forced out of shaped portion A5 to shaped portion A4 via liquid channel K5, and oil is forced out of shaped portion A4 towards the oil extraction region 5 via liquid channel K4.

From this, it can be seen that liquid delivery from shaped portion to shaped portion towards the oil extraction region 5 can be provided in the context of the invention.

Consequently, the dividing wall structure 1 can perform an integrated oil delivery function together with the turning crankshaft and/or connecting-rod sections.

A gap S for receiving oil between shaped portions A1 to A6 and the turning crankshaft and/or connecting-rod sections is expediently formed between shaped portions A1 to A6 and the turning crankshaft and/or connecting-rod sections. It is self-evident that a respective gap S is expediently formed for each connecting rod 3.1 to 3.6 and/or for each shaped portion A1 to A6. The gaps S can be of identical or different dimensions.

In particular, shaped portions A1 to A6 are designed in accordance with the envelope geometry of the turning motion of the crankshaft and/or connecting-rod sections, plus a clearance dimension to form the gap S. It follows from this that shaped portions A1 to A6 mirror the envelope geometry of a rotational motion of the crankshaft, plus a defined clearance to form the gap S.

Due to the turning motion of the crankshaft and/or connecting-rod sections, oil can be forced out of the respective gap S into the respective liquid channel K1 to K6.

The oil suction cage in the oil extraction region 5 must be below the oil level in the oil extraction region 5 at all times, especially in any sloping position; otherwise, air would be drawn in and, as a result, lubrication of the vehicle structure V (in particular of the engine) would no longer be guaranteed.

In particular, oil delivery from the shaped portions A1 to A6 and thus the effectiveness of the oil delivery function integrated into the dividing wall structure 1 depend on the size of the gap S (the smaller the gap S, the smaller the gap losses) and on the passage cross sections of oil channels K1 to K6.

In particular, oil delivery from the shaped portions A1 to A6 and thus the effectiveness of the oil delivery function integrated into the dividing wall structure 1 furthermore depend on the operating state of the vehicle device V, in particular on the engine and/or crankshaft speed of the vehicle device V.

If the vehicle device V is in a steeply sloping position, the oil delivery function ensures that there is continuous oil delivery from shaped portions A1 to A6 to the oil extraction region 5, thus making it possible to reduce or even entirely avoid the risk of air being drawn in.

Figure 2:
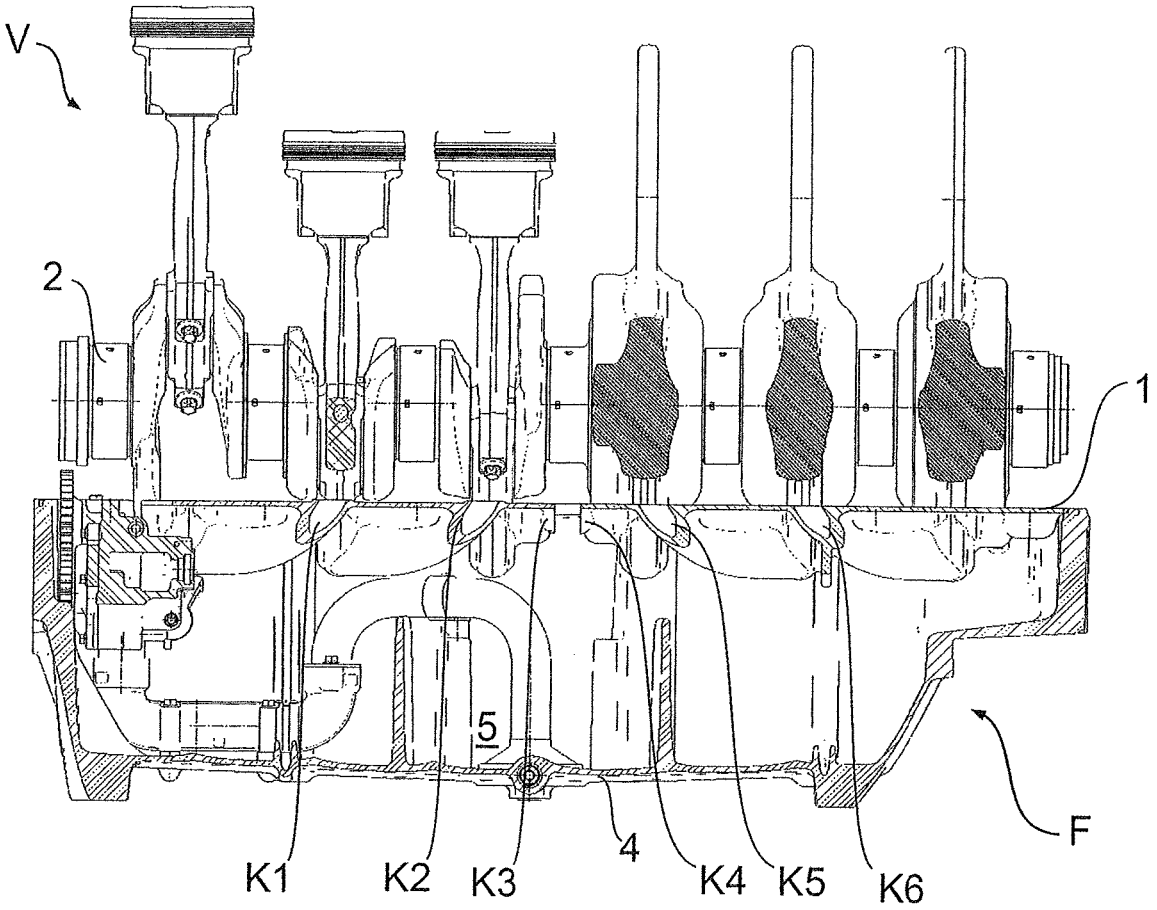
FIG. 2 is another section through the dividing wall structure and the collecting device.

FIG. 2 shows another section through the dividing wall structure 1 and the oil collecting device F of FIG. 1, wherein not all parts are provided with reference signs for purposes of illustration.

Figure 3:
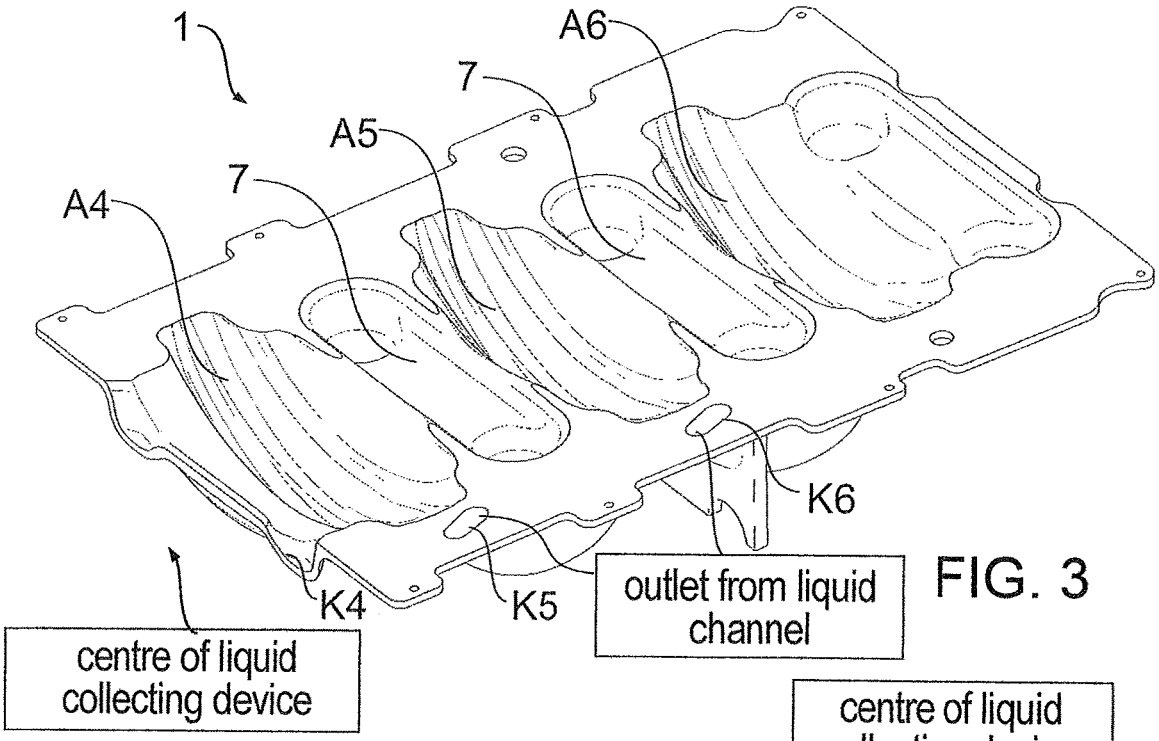
FIG. 3 is a perspective view of a dividing wall structure.
Figure 4:
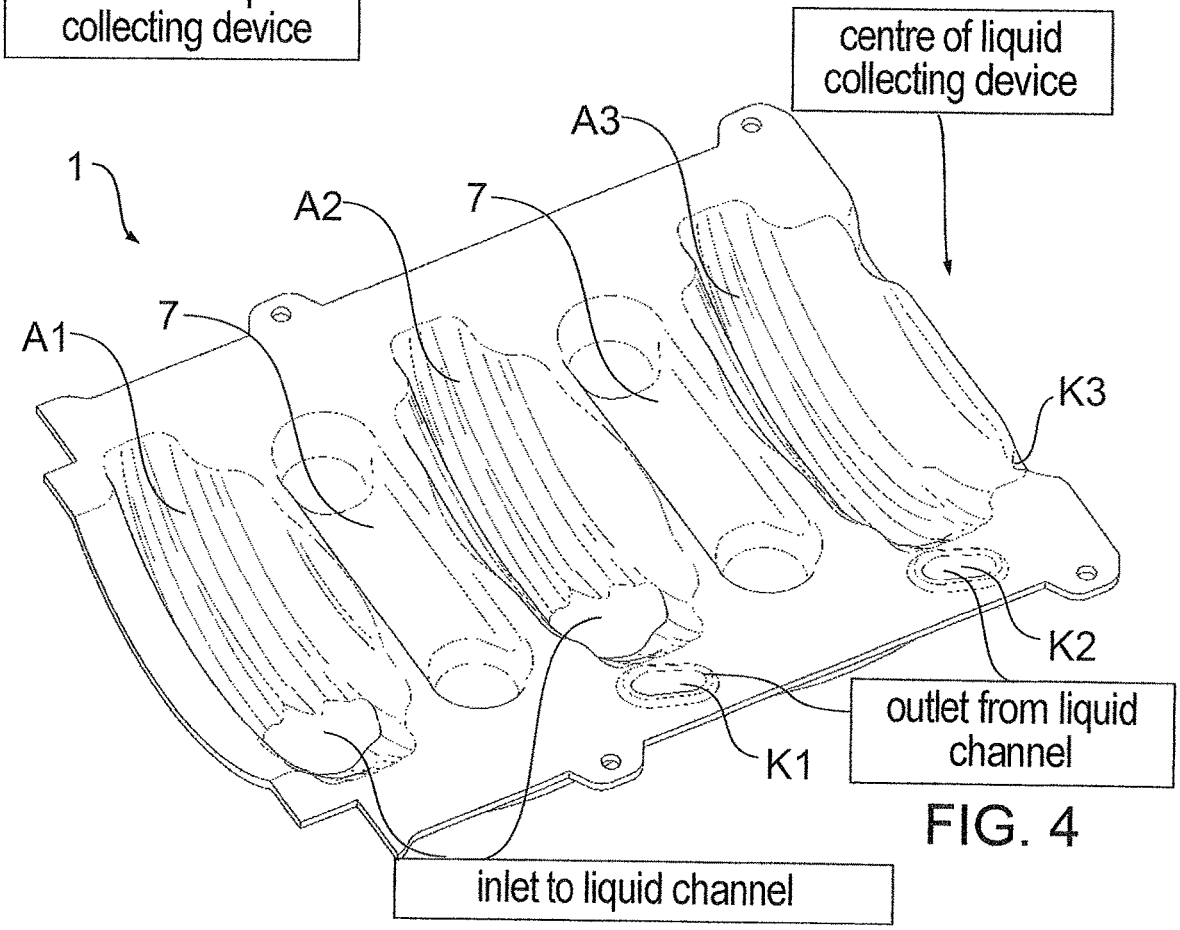
FIG. 4 is a perspective view of a dividing wall structure.

FIGS. 3 and 4 show a dividing wall structure 1 according to one embodiment of the invention, which is embodied as in FIGS. 1 and 2.

FIG. 3 shows, in particular, shaped portions A4 to A6 and the associated channels K4 to K6, while FIG. 4 shows, in particular, shaped portions A1 to A3 and the associated channels K1 to K3.

Reference sign 7 denotes optional recesses in the dividing wall structure 1 for the crankshaft bearings.

Oil channels K3 and K4 are of very short design and, in the context of the invention, can be embodied as simple oil passage openings.

FIG. 4 shows that an inlet of an oil channel can be formed in a shaped portion but that the associated outlet does not necessarily have to be formed in a shaped portion but can also be formed adjacent thereto. In the latter case, the dividing wall structure 1 can expediently be embodied in such a way that oil can flow out of the outlet into the associated shaped portion. For this purpose, the dividing wall structure 1 can have a section sloping towards the associated shaped portion.

Figure 5:
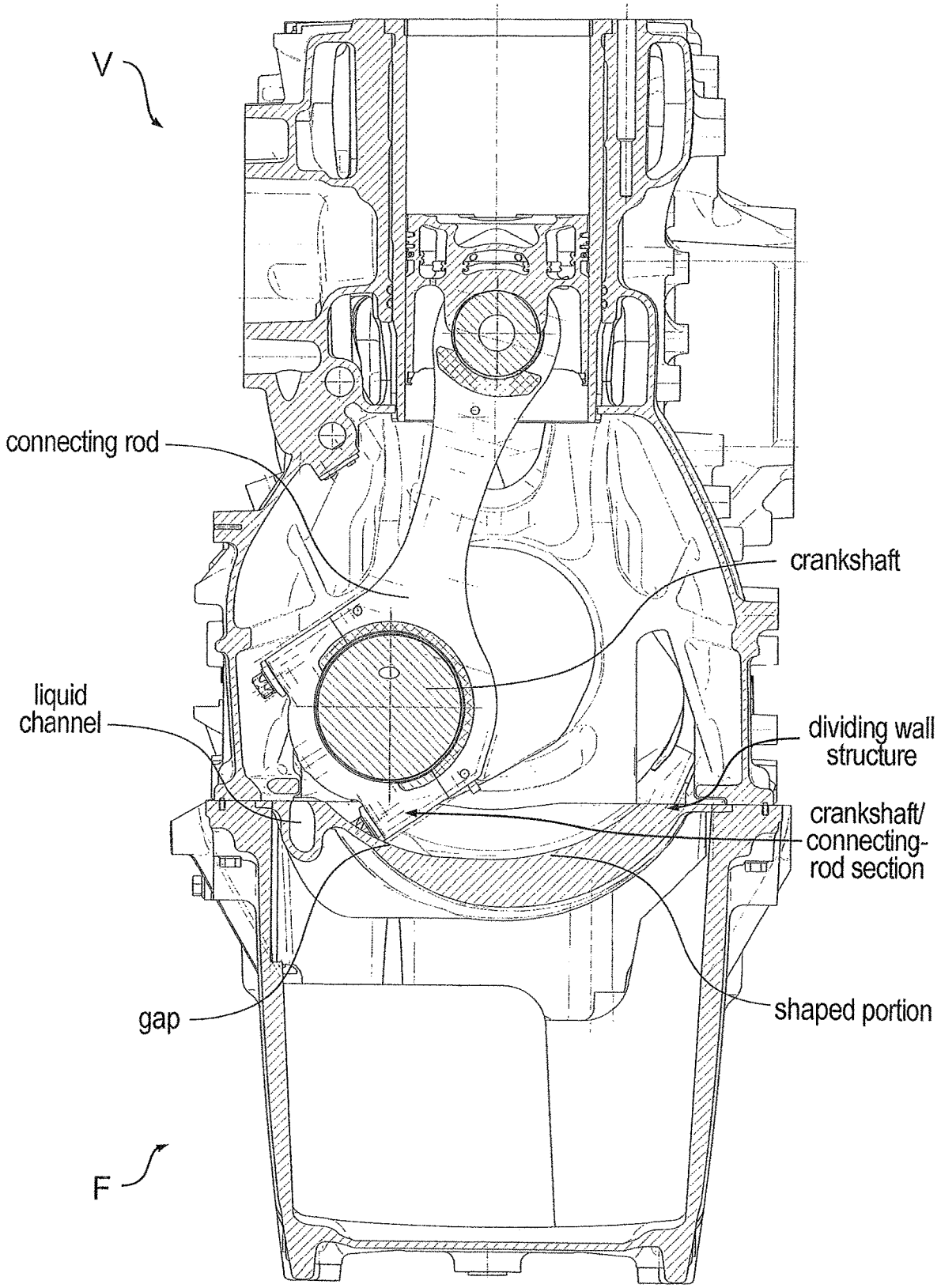
FIG. 5 is a section through the dividing wall structure and the liquid collecting device in FIGS. 1 and 2.

FIG. 5 shows a section through the dividing wall structure 1 and the oil collecting device F together with the vehicle structure V from FIGS. 1 and 2.

It is once again possible to see from FIG. 5 the principle of operation of the invention, namely that a shaped portion for receiving a turning lower crankshaft and/or connecting-rod section is formed in the dividing wall structure, and oil can be delivered out of the shaped portion, in particular out of the gap between the shaped portion and the turning crankshaft and/or connecting-rod section, by the turning crankshaft and/or connecting-rod section into an oil channel in particular, thus expediently making possible oil delivery towards the oil extraction region.

One shaped portion is provided for each connecting rod in the context of the invention.

Figure 6:
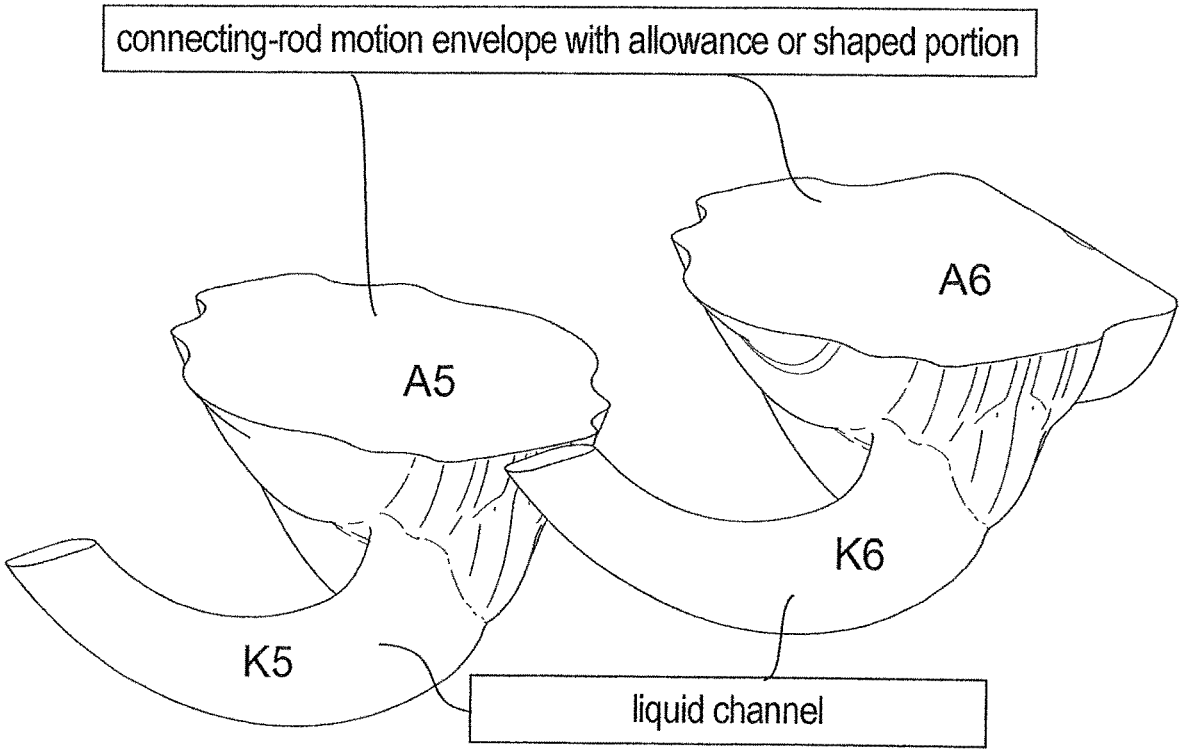
FIG. 6 is a schematic view of a liquid channel and of a connecting-rod motion envelope with allowance or a shaped portion.

FIG. 6 shows a schematic perspective view of two adjacent shaped portions A6 and A5, in particular two connecting-rod motion envelopes with an allowance.

From FIG. 6, it can first of all be seen that oil channels K6 are used to connect the two shaped portions A6 and A5. The inlet of oil channel K6 is formed in shaped portion A6, while the outlet thereof is adjacent to shaped portion A5. The inlet of oil channel K5 is formed in shaped portion A5, while the outlet thereof can be formed in shaped portion A4 or adjacent thereto.

FIG. 6 furthermore shows that the passage cross section of the respective oil channels K6 and K5 are embodied so as to taper, namely in the direction of oil delivery, i.e. from shaped portion A6 to shaped portion A5. It is thereby possible to achieve a pressure drop and/or an oil delivery effect.

The narrowing passage cross section causes acceleration of the oil delivered. The oil mass flow at the outlet of an oil channel can be projected against the adjacent shaped portion or flow out adjacent thereto.

Figure 7:
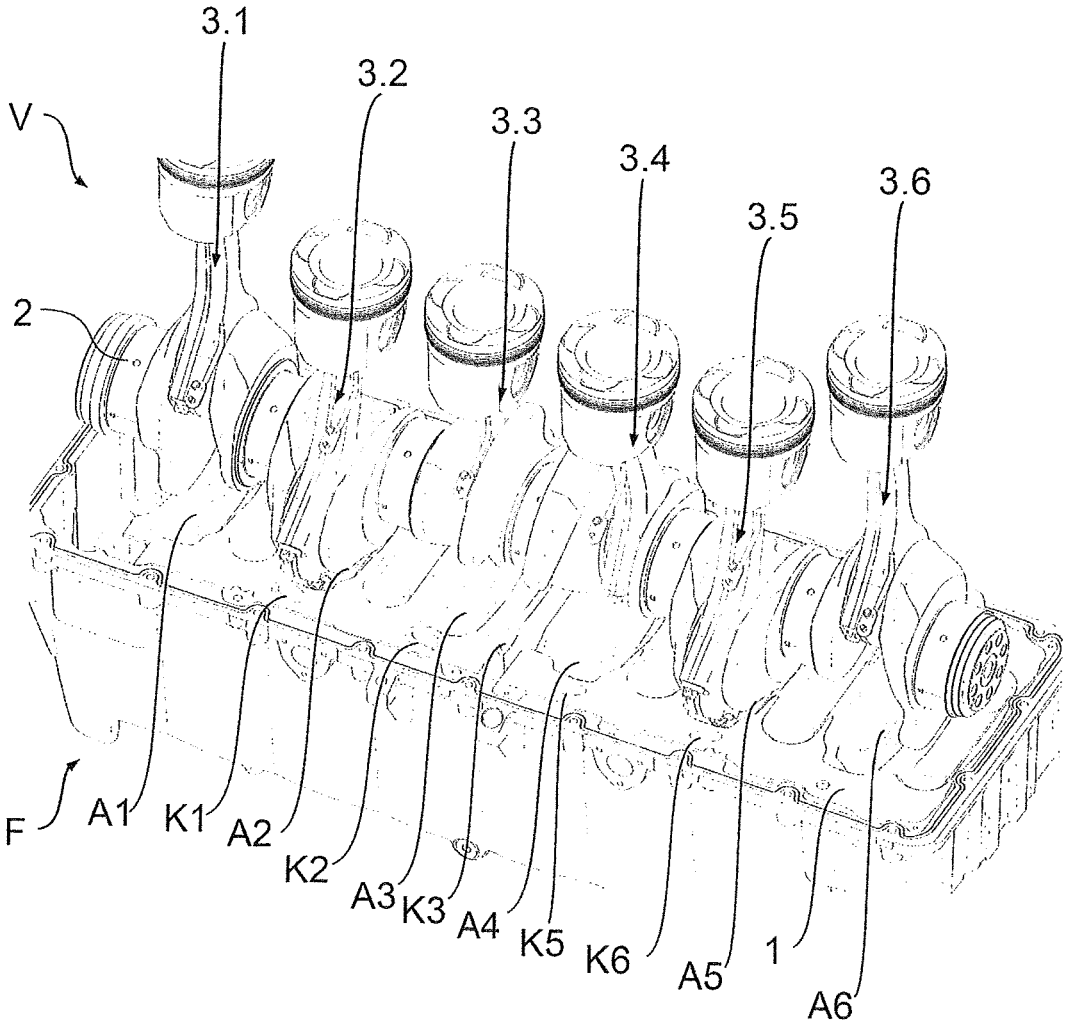
FIG. 7 is a perspective view of the dividing wall structure and of the liquid collecting device.

FIG. 7 shows a perspective view of the dividing wall structure 1, of the oil collecting device F and of the vehicle structure V with the crankshaft 2 and the connecting rods 3.1 to 3.6.

Once again, it can be seen that a respective shaped portion A1 to A6 is formed in the dividing wall structure 1 for each connecting rod 3.1 to 3.6 and thus for each connecting-rod and/or crankshaft section. One oil channel K1 to K6 is likewise formed for each shaped portion A1 to A6.

Figure 8:
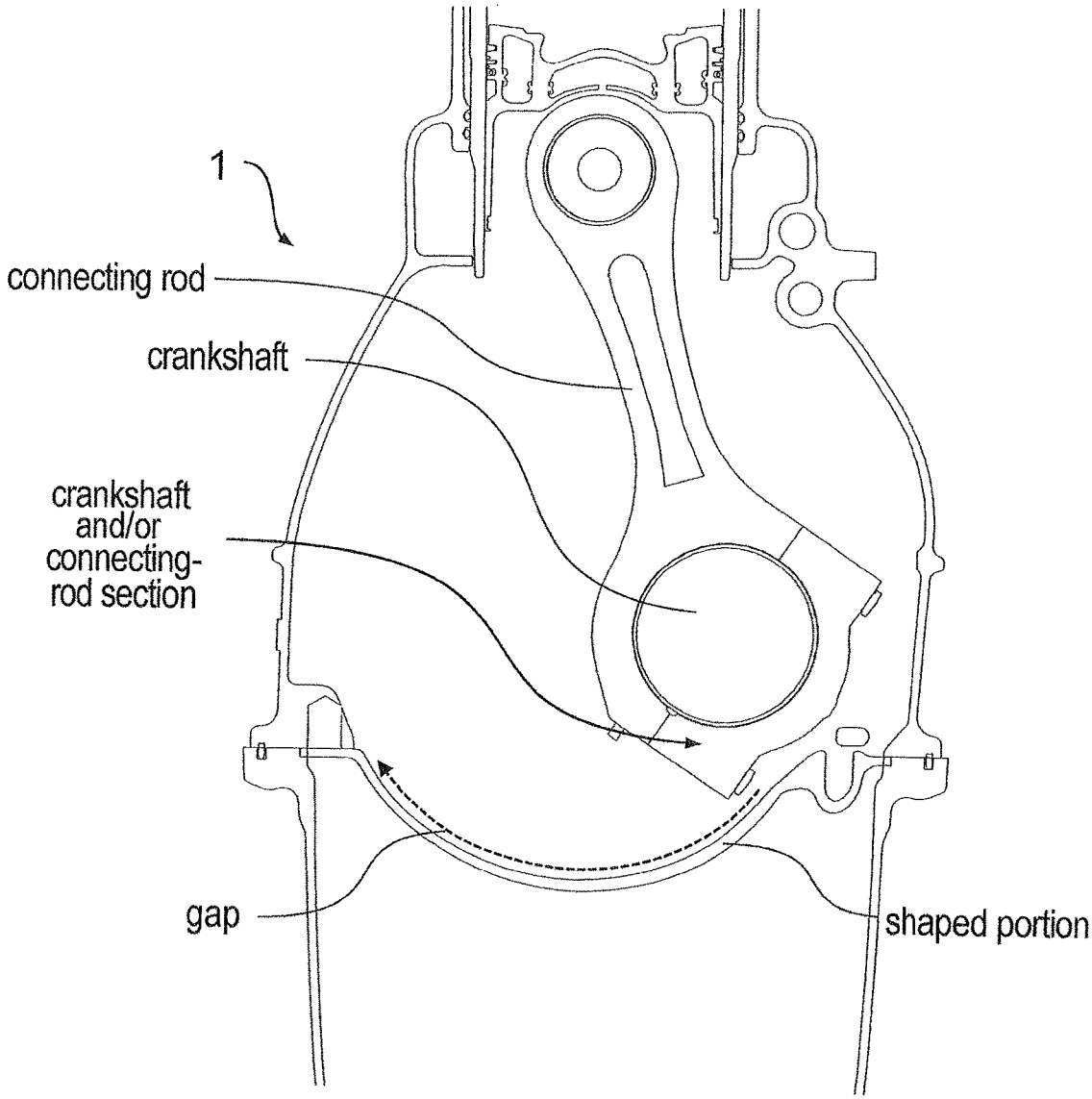
FIG. 8 is a schematic view of the dividing wall structure and of the liquid collecting device.

FIG. 8 shows a simplified sectional view to illustrate once again the principle of operation of the invention. The crankshaft, a connecting rod, a crankshaft and/or connecting-rod section, in particular a lower crankshaft and/or connecting-rod section, expediently a lowermost crankshaft and/or connecting-rod section, and a shaped portion can be seen and are designated, in particular.

The invention is not restricted to the preferred embodiments described above. On the contrary, a large number of variants and modifications is possible which likewise make use of the inventive concept and thus fall within the scope of protection. Moreover, the invention also claims protection for the subject matter and features of the dependent claims independently of the features and claims to which reference is made.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A dividing wall structure for a liquid collecting device for a vehicle structure having a crankshaft and connecting rods, comprising a plurality of shaped portions arranged in the dividing wall structure and configured to accommodate at least one of a turning crankshaft and connecting-rod sections; and a plurality of liquid channels arranged in the dividing wall structure, whereby liquid can be forced out of the shaped portions, wherein at least one liquid channel directly connects a shaped portion to a liquid extraction region, such that liquid delivery towards a liquid extraction region is made possible, wherein at least one liquid channel connects a first shaped portion of the plurality of shaped portions to a second shaped portion of the plurality of shaped portions, such that liquid delivery from the first shaped portion to the second shaped portion is made possible.

2. The dividing wall structure according to claim 1, wherein the liquid can be forced out of respective shaped portions via respective liquid channels.

3. The dividing wall structure according to claim 2, wherein the at least one liquid channel that connects the first shaped portion of the plurality of shaped portions to the second shaped portion of the plurality of shaped portions, such that liquid delivery towards a liquid extraction region is made possible.

4. The dividing wall structure according to claim 1, wherein the at least one liquid channel that connects the first shaped portion of the plurality of shaped portions to the second shaped portion of the plurality of shaped portions, such that liquid delivery towards a liquid extraction region is made possible.

5. The dividing wall structure according to claim 1, wherein the at least one liquid channel connects the shaped portion to the liquid extraction region, such that liquid delivery from a first shaped portion of the plurality of shaped portions to a second shaped portion of the plurality of shaped portions is made possible.

6. The dividing wall structure according to claim 1, wherein at least one liquid channel has a liquid inlet formed in one of a respective shaped portion and adjacent to the respective shaped portion.

7. The dividing wall structure according to claim 1, wherein at least one liquid channel has a liquid outlet formed in one of a respective shaped portion and adjacent to the respective shaped portion.

8. The dividing wall structure according to claim 1, wherein at least one liquid channel has a channel cross section that tapers in a direction of liquid delivery.

9. The dividing wall structure according claim 1, wherein a gap for receiving the liquid is formed between each of the plurality of the shaped portions and at least one of the turning crankshaft and the connecting-rod sections.

10. The dividing wall structure according to claim 9, wherein the gap is configured such that the liquid can be forced out of the gap into the liquid channels by the turning of the at least one of the crankshaft and the connecting-rod sections.

11. The dividing wall structure according to claim 1, wherein the shaped portions are designed in accordance with an envelope geometry of the turning of at least one of the crankshaft and the connecting-rod sections, including a clearance dimension to form a gap to receive liquid between the shaped portions and the one of the turning crankshaft and the connecting-rod sections.

12. The dividing wall structure according to claim 11, wherein the gap is configured such that the liquid can be forced out of the gap into the liquid channels by the turning of the at least one of the crankshaft and the connecting-rod sections.

13. The dividing wall structure according to claim 1, wherein the liquid can be forced out of the shaped portions into the liquid channels by the turning of the at least one of the crankshaft and the connecting-rod sections.

14. The dividing wall structure according to claim 1, wherein the dividing wall structure is at least one of:

configured to be arranged under the vehicle structure and configured to form a cover unit for the liquid collecting device.

15. The dividing wall structure according to claim 1, wherein the dividing wall structure is a moulding with at least one of integrated shaped portions and integrated liquid channels.

16. The dividing wall structure according to claim 15, wherein the dividing wall structure is a plastic moulding.

17. A liquid collecting device for a vehicle structure comprising a crankshaft and connecting rods, having a dividing wall structure, comprising a plurality of shaped portions arranged in the dividing wall structure and configured to accommodate at least one of a turning crankshaft and connecting-rod sections; and a plurality of liquid channels arranged in the dividing wall structure, whereby liquid can be forced out of the shaped portions, wherein at least one liquid channel directly connects a shaped portion to a liquid extraction region, such that liquid delivery towards a liquid extraction region is made possible, wherein at least one liquid channel connects a first shaped portion of the plurality of shaped portions to a second shaped portion of the plurality of shaped portions, such that liquid delivery from the first shaped portion to the second shaped portion is made possible.

18. The liquid collecting device according to claim 17, further comprising:

a liquid trough configured to receive the liquid; and a liquid extraction region, wherein the liquid extraction region is arranged substantially in a center of the liquid trough.

19. The liquid collecting device according to claim 18, wherein the liquid collecting device has a pump unit configured to extract the liquid from the liquid extraction region.

20. An arrangement having a vehicle structure, which comprises a crankshaft and connecting rods, and a liquid collecting device having a dividing wall structure, comprising a plurality of shaped portions arranged in the dividing wall structure and configured to accommodate at least one of a turning crankshaft and connecting-rod sections; and a plurality of liquid channels arranged in the dividing wall structure, whereby liquid can be forced out of the shaped portions, wherein at least one liquid channel directly connects a shaped portion to a liquid extraction region, such that liquid delivery towards a liquid extraction region is made possible, wherein at least one liquid channel connects a first shaped portion of the plurality of shaped portions to a second shaped portion of the plurality of shaped portions, such that liquid delivery from the first shaped portion to the second shaped portion is made possible.

* * * * *